US009416649B2

(12) United States Patent
Andarawis et al.

(10) Patent No.: US 9,416,649 B2
(45) Date of Patent: Aug. 16, 2016

(54) METHOD AND SYSTEM FOR DETERMINATION OF PIPE LOCATION IN BLOWOUT PREVENTERS

(71) Applicant: General Electric Company, Schenectady, NY (US)

(72) Inventors: Emad Andarawis Andarawis, Ballston Lake, NY (US); Daniel White Sexton, Niskayuna, NY (US); Christopher Edward Wolfe, Niskayuna, NY (US); Edward James Nieters, Burnt Hills, NY (US); Yuri Alexeyevich Plotnikov, Niskayuna, NY (US); Michael Joseph Dell'Anno, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 294 days.

(21) Appl. No.: 14/157,803

(22) Filed: Jan. 17, 2014

(65) Prior Publication Data

US 2015/0204182 A1 Jul. 23, 2015

(51) Int. Cl.

| | |
|---|---|
| ***E21B 47/00*** | (2012.01) |
| ***E21B 33/06*** | (2006.01) |
| ***E21B 47/09*** | (2012.01) |

(52) U.S. Cl.

CPC ..... *E21B 47/0001* (2013.01); *E21B 33/06* (2013.01); *E21B 47/09* (2013.01)

(58) Field of Classification Search

CPC ..... E21B 47/0905; E21B 47/12; E21B 33/06; E21B 47/0001; E21B 47/09

See application file for complete search history.

(56) References Cited

U.S. PATENT DOCUMENTS

| | | | | |
|---|---|---|---|---|
| 3,103,976 | A * | 9/1963 | De Vries | E21B 7/128 166/255.1 |
| 3,843,923 | A | 10/1974 | DeVries et al. | |
| 4,422,041 | A * | 12/1983 | Lienau | G01B 7/003 324/174 |
| 4,440,239 | A * | 4/1984 | Evans | E21B 21/08 175/38 |
| 4,922,423 | A | 5/1990 | Koomey et al. | |
| 6,429,784 | B1 * | 8/2002 | Beique | E21B 17/14 166/250.07 |
| 6,484,816 | B1 | 11/2002 | Koederitz | |

(Continued)

FOREIGN PATENT DOCUMENTS

| | | | |
|---|---|---|---|
| CA | 2536451 | A1 | 8/2007 |
| CN | 201159080 | Y | 12/2008 |

OTHER PUBLICATIONS

PCT Search Report and Written Opinion issued in connection with corresponding PCT Application No. PCT/US2015/011495 on Jun. 25, 2015.

*Primary Examiner* — Daniel P Stephenson
(74) *Attorney, Agent, or Firm* — Jason K. Klindtworth

(57) ABSTRACT

A system to detect a position of a pipe with respect to a BOP includes a casing disposed around an outer surface of a section of the pipe. The system further includes sensing devices that are disposed on the casing and arranged to form a plurality of arrays and configured to generate position signals. The arrays are disposed circumferentially around the casing and spaced from one another along the length of the casing. The system includes a processing unit configured to compute distance between the pipe and each sensing device. The processing unit generates a first alert when the distance between the pipe and at least one sensing device is different from a reference distance. The processing unit generates a second alert when the distance between the pipe and each sensing device of at least one array of sensing devices is different from the reference distance.

19 Claims, 5 Drawing Sheets

(56) References Cited

U.S. PATENT DOCUMENTS 6,720,764 B2 4/2004 Relton et al.
6,815,945 B2 11/2004 Biester et al.
6,860,327 B2 3/2005 George
7,038,445 B2 * 5/2006 Walters ..... G01N 27/82 324/240
7,274,989 B2 9/2007 Hopper
7,347,261 B2 3/2008 Markel et al.
2002/0063866 A1 * 5/2002 Kersey ..... G01D 5/35383 356/478
2003/0052670 A1 3/2003 Miszewski
2003/0117133 A1 6/2003 Miszewski et al.
2005/0173111 A1 * 8/2005 Bostick, III ..... E21B 47/011 73/152.16
2009/0091328 A1 * 4/2009 Clark ..... G01V 3/28 324/338
2010/0259267 A1 * 10/2010 Rosthal ..... G01V 3/30 324/339
2012/0001100 A1 * 1/2012 Hubbell, Jr. ..... E21B 33/038 251/1.1
2012/0197527 A1 8/2012 McKay et al.
2013/0088362 A1 4/2013 Yates et al.
2013/0153241 A1 6/2013 Mallinson et al.
2013/0167628 A1 * 7/2013 Hull ..... E21B 47/12 73/152.58
2014/0169127 A1 * 6/2014 Orban ..... G01V 1/40 367/25
2015/0014521 A1 * 1/2015 Barfoot ..... E21B 47/123 250/261
2015/0075783 A1 * 3/2015 Angman ..... E21B 43/26 166/250.01
2015/0204182 A1 * 7/2015 Andarawis ..... E21B 47/0001 166/255.1

* cited by examiner

METHOD AND SYSTEM FOR DETERMINATION OF PIPE LOCATION IN BLOWOUT PREVENTERS

BACKGROUND

Embodiments of the present invention relate generally to blowout preventers, and more particularly, to a method and system to monitor the position of a pipe in a blowout preventer.

Oil and gas field operations typically involve drilling and operating wells to locate and retrieve hydrocarbons. Rigs are positioned at well sites in relatively deep water. Tools, such as drilling tools, tubing and pipes are deployed at these wells to explore submerged reservoirs. It is important to prevent spillage and leakage of fluids from the well into the environment.

While well operators generally do their utmost to prevent spillage or leakage, the penetration of high-pressure reservoirs and formations during drilling can cause a sudden pressure increase ("kick") in the wellbore itself. A significantly large pressure kick can result in a "blowout" of drill pipe, casing, drilling mud, and hydrocarbons from the wellbore, which can result in failure of the well.

Blowout preventers ("BOPs") are commonly used in the drilling and completion of oil and gas wells to protect drilling and operational personnel, as well as the well site and its equipment, from the effects of a blowout. In a general sense, a blowout preventer is a remotely controlled valve or set of valves that can close off the wellbore in the event of an unanticipated increase in well pressure. Modern blowout preventers typically include several valves arranged in a "stack" surrounding the drill string. The valves within a given stack typically differ from one another in their manner of operation, and in their pressure rating, thus providing varying degrees of well control. Many BOPs include a valve of a "blind shear ram" type, which can serve to sever and crimp the drill pipe, serving as the ultimate emergency protection against a blowout if the other valves in the stack cannot control the well pressure.

In modern deep-drilling wells, particularly in offshore production, the control systems involved with conventional blowout preventers have become quite complex. As known in the art, the individual rams in blowout preventers can be controlled both hydraulically and also electrically. In addition, some modern blowout preventers can be actuated by remote operated vehicles (ROVs), should the internal electrical and hydraulic control systems become inoperable. Typically, some level of redundancy for the control systems in modern blowout preventers is provided.

During a blowout, when the valves of the BOP are activated, the shear rams are expected to sever the drill pipe to prevent the blowout from affecting drilling equipment upstream. The shear rams are placed such that the drill pipe is severed from more than one side when the valves of the BOP are actuated. Although BOPs are an effective method for preventing blowouts, the rams can sometimes fail to sever the drill pipe for several reasons including lateral movement of the pipe inside the BOP, and presence of a pipe-joint in the proximity of shear rams.

Given the importance of BOPs in present-day drilling operations, especially in deep offshore environments, it is important for the well operator to have confidence that a deployed BOP is functional and operable. Further, it is also desirable for the well operator to know the position of the pipe with respect to the BOP. In addition, the operator would also find it useful to determine the nature of movement of the pipe in the BOP.

As a result, the well operator will regularly functionally test the BOP, such tests including periodic functional tests of each valve to detect the presence of tool-joints in the BOP, periodic pressure tests of each valve to ensure that the valves seal at specified pressures, periodic actuation of valves by an ROV, and the like. Such tests may also be required by regulatory agencies. Of course, such periodic tests consume personnel and equipment resources, and can require shutdown of the drilling operation.

In addition to these periodic tests, the functionality and health of modern BOPs can be monitored during drilling, based on sensing signals produced by sensing systems placed in the BOP, and indirectly from downhole pressure measurements and the like. However, in conventional blowout preventer control systems, these various inputs and measurements generate a large amount of data over time. Given the large amount of data, the harsh downhole environment in which the blowout preventer is deployed, and the overwhelming cost in resources and downtime required to perform maintenance and replacement of blowout preventer components, off-site expert personnel such as subsea engineers are assigned the responsibility of determining BOP functional status. This analysis is generally time-consuming and often involves the subjective judgment of the analyst. Drilling personnel at the well site often are not able to readily determine the operational status or "health" of blowout preventers, much less do it in a timely and comprehensible manner.

In addition, sensing systems are sensitive to the presence of foreign material in the drill pipe and may produce erroneous results that lead to false positives. Examples of foreign material include, but are not limited to, debris caused due drilling and cutting, or water, or gas bubbles, and the like. Further, changes in environmental conditions may also lead to sensor drifts. The sensor drift may cause changes in output of the sensing systems thus causing errors in determination of position of the pipe in the BOP.

Since the corrective actions required to enable efficient operation of the BOP are dependent on determination of the pipe location with respect to the BOP, it is important for the sensing systems to produce accurate results. Hence, there is a need for a method and system that aids in determination of pipe location in a BOP while factoring movement of the pipe as well as the presence of pipe-joints in the BOP.

BRIEF DESCRIPTION

A system to detect a position of a pipe with respect to a blowout preventer (BOP) is provided. The system includes casing configured to be disposed around an outer surface of a section of the pipe. The length of the casing is greater than or equal to a length of the section of the pipe. Further, the system includes a plurality of sensing devices configured to generate a plurality of position signals. The plurality of sensing devices are arranged to form a plurality of arrays of sensing devices. Each of the plurality of arrays is disposed circumferentially around the casing and spaced from one another along the length of the casing. Furthermore, the system includes a processing unit that is configured to compute a distance between the pipe and each of the plurality of sensing devices based on the plurality of position signals. The processing unit is further configured to generate a first alert when the distance of the pipe determined from at least one sensing device is different from a reference distance between the pipe and the sensing devices. The processing unit to generate a second alert when the distance between the pipe and each sensing device of at least one array of sensing devices is different from the reference distance between the pipe and sensing devices.

A method for monitoring a position of a pipe with respect to a blow-out preventer (BOP) is provided. The method includes receiving a plurality of position signals from a plurality of sensing devices. The sensing devices are disposed on a casing to form a plurality of arrays of sensing devices along the length of the casing. The casing, on the other hand, is disposed on an outer surface of a section of the pipe. Further, the method includes computing a reference distance between the plurality of sensing devices and the section of the pipe. Furthermore, the method includes comparing a distance between each sensing device and the pipe with the reference distance. The method also includes generating at least one of a plurality of alerts when the reference distance is greater than at least one of a distance between at least one sensing device and the pipe or an average distance between sensing devices of at least one array and the pipe.

DRAWINGS

Other features and advantages of the present disclosure will be apparent from the following more detailed description of the preferred embodiment, taken in conjunction with the accompanying drawings which illustrate, by way of example, the principles of certain aspects of the disclosure.

DETAILED DESCRIPTION

Figure 1:
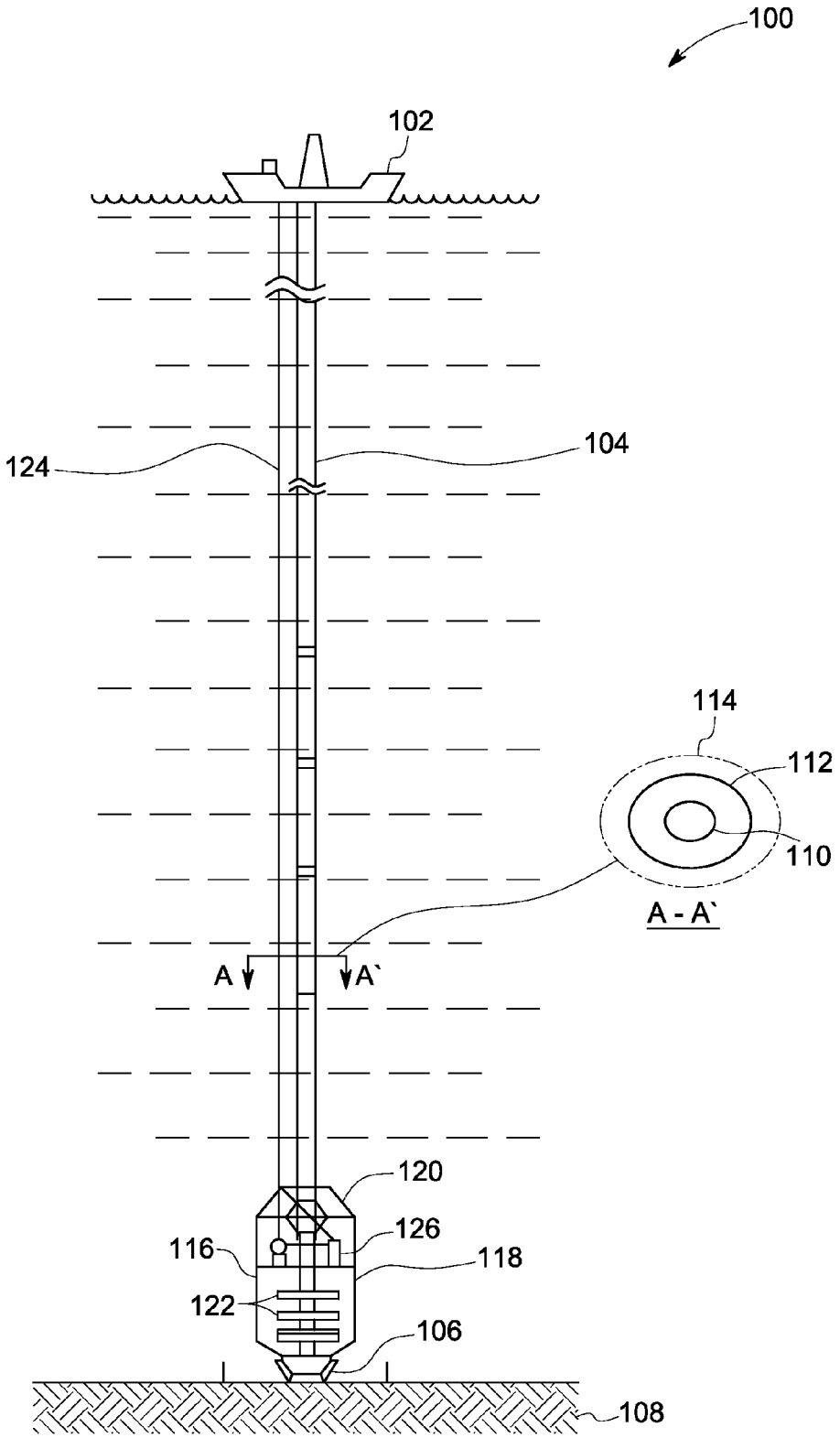
FIG. 1 illustrates a typical oil and gas exploration system that includes blowout preventers.

Reference will be made below in detail to exemplary embodiments of the invention, examples of which are illustrated in the accompanying drawings. Wherever possible, the same reference numerals used throughout the drawings refer to the same or like parts.

Embodiments of the present invention provide for a system and method for determination of a position of a drill pipe in a blowout preventer (BOP). In oil and gas exploration system, drilling rigs are installed to drill through the sea surface and extract oil stored in the sea bed. The drilling process involves disposing multiple pipe sections to form pipe lengths that can stretch for multiple kilometers along with drill bits to drill through the sea bed. Pipes are installed in the drilling rigs to pump out the oil and gas discovered during drilling. Further pipes are also utilized to carry the waste material being cut by the drill bits and deposit it back in the sea bed. BOPs are installed around these pipes to prevent damage of equipment present on the sea floor caused by kicks and blowouts during drilling. The BOP, according to many embodiments, includes shear rams that can be electrically and/or hydraulically actuated. The rams are configured to sever the drill pipes when a blowout occurs. However, on certain occasions the shear rams may encounter pipe joints, which have a larger diameter than the remaining pipe, and may not be able to sever the pipe joints in the event of a kick. Further, BOPs installed with sensors to determine location of the pipe with respect to the shear rams may produce incorrect responses when characteristics of the fluid flowing the pipe changes. While the forthcoming paragraphs describe the method and system with respect to a shear ram, it may be obvious that the present embodiments may be applied to BOPs that include blind rams, pipe rams, annular rams, and the like.

Embodiments of the present invention, as described in the forthcoming paragraphs, provide for a method and system to detect the position of a pipe with respect to the BOP while eliminating the incorrect responses that may be caused due to presence of fluids. Further, embodiments of the system for determination of the position of pipe also detect the presence of pipe joints in the BOP. Accordingly, the present system includes a casing that is configured to be disposed circumferentially around an outer surface of a section of the pipe to be monitored. The length of the casing is selected to be longer than that of the section of interest of the pipe. The system further includes a plurality of sensing devices. The plurality of sensing devices are arranged to form a plurality of arrays of sensing devices. The arrays are arranged circumferentially on the casing and are placed along the length of the casing. The arrangement is made such that the plurality of sensing devices cover the length of the section of the pipe to be monitored and also cover the circumference of the section of the pipe at multiple locations. The sensing devices are configured to generate position signals that determine the position of the pipe with respect to each of the sensing devices. The position signals generated by the sensing devices are transmitted to a processing unit. The processing unit is configured to compare distances of the section of the pipe with respect to each of the plurality of sensing devices. Further, the processing unit is configured to generate a first alert when the distance between the section of interest of the pipe and at least one sensing device in any of the plurality of arrays is different from a reference distance. Furthermore, the processing unit is configured to generate a second alert when the distance between the section of interest of the pipe and each sensing device within at least one array is different from the reference distance. The reference distance is an expected distance between the section of interest of the pipe and sensing devices. The expected distance is a distance between the section of interest of the pipe and the sensing devices, when the pipe is parallel to the BOP stack and when the section of interest does not include a pipe joint.

A traditional offshore oil and gas installation 100, as illustrated in FIG. 1, includes a platform 102 (or any other type of vessel at the water surface) connected via a riser/drill pipe 104 to a wellhead 106 on the seabed 108. It is noted that the elements shown in FIG. 1 are not drawn to scale and no dimensions should be inferred from relative sizes and distances illustrated in FIG. 1.

Inside the drill pipe 104, as shown in the cross-section view, there is a drill string 110 at the end of which a drill bit (not shown) is rotated to extend the subsea well through layers below the seabed 108. Mud is circulated from a mud tank (not shown) on the drilling platform 102 through the drill string 110 to the drill bit, and returned to the drilling platform 102 through an annular space 112 between the drill string 110 and a protective casing 114 of the drill pipe 104. The mud maintains a hydrostatic pressure to counter-balancing the pressure of fluids coming out of the well and cools the drill bit while also carrying crushed or cut rock to the surface through the annular space 112. At the surface, the mud returning from the well is filtered to remove the rock and debris and is recirculated.

During drilling, gas, oil or other well fluids at a high pressure may burst from the drilled formations into the drill pipe 104 and may occur at unpredictable moments. In order to protect the well and/or the equipment that may be damaged, a blowout preventer (BOP) stack 116 is located close to the seabed 108. The BOP stack may also be located at different locations along the drill pipe 104 according to requirements of specific offshore rigs. The BOP stack may include a lower BOP stack 118 attached to the wellhead 106, and a Lower Marine Riser Package ("LMRP") 120, which is attached to a distal end of the drill pipe 104. During drilling, the lower BOP stack 118 and the LMRP 120 are connected.

A plurality of blowout preventers (BOPs) 122 located in the lower BOP stack 118 or in the LMRP 120 are in an open state during normal operation, but may be closed (i.e., switched to a close state) to interrupt a fluid flow through the drill pipe 104 when a "kick" occurs. Electrical cables and/or hydraulic lines 124 transport control signals from the drilling platform 102 to a controller 126, which may be located on the BOP stack 116. The controller 126 and the BOP stack 116 may also be at remote locations with respect to each other. Further, the controller 126 and the BOP stack 116 may be coupled by wired as well as wireless networks that aid transfer of data between them. The controller 126 controls the BOPs 122 to be in the open state or in the closed state, according to signals received from the platform 102 via the electrical cables and/or hydraulic lines 124. The controller 126 also acquires and sends to the platform 102, information related to the current state (open or closed) of the BOPs 122.

Figure 2:
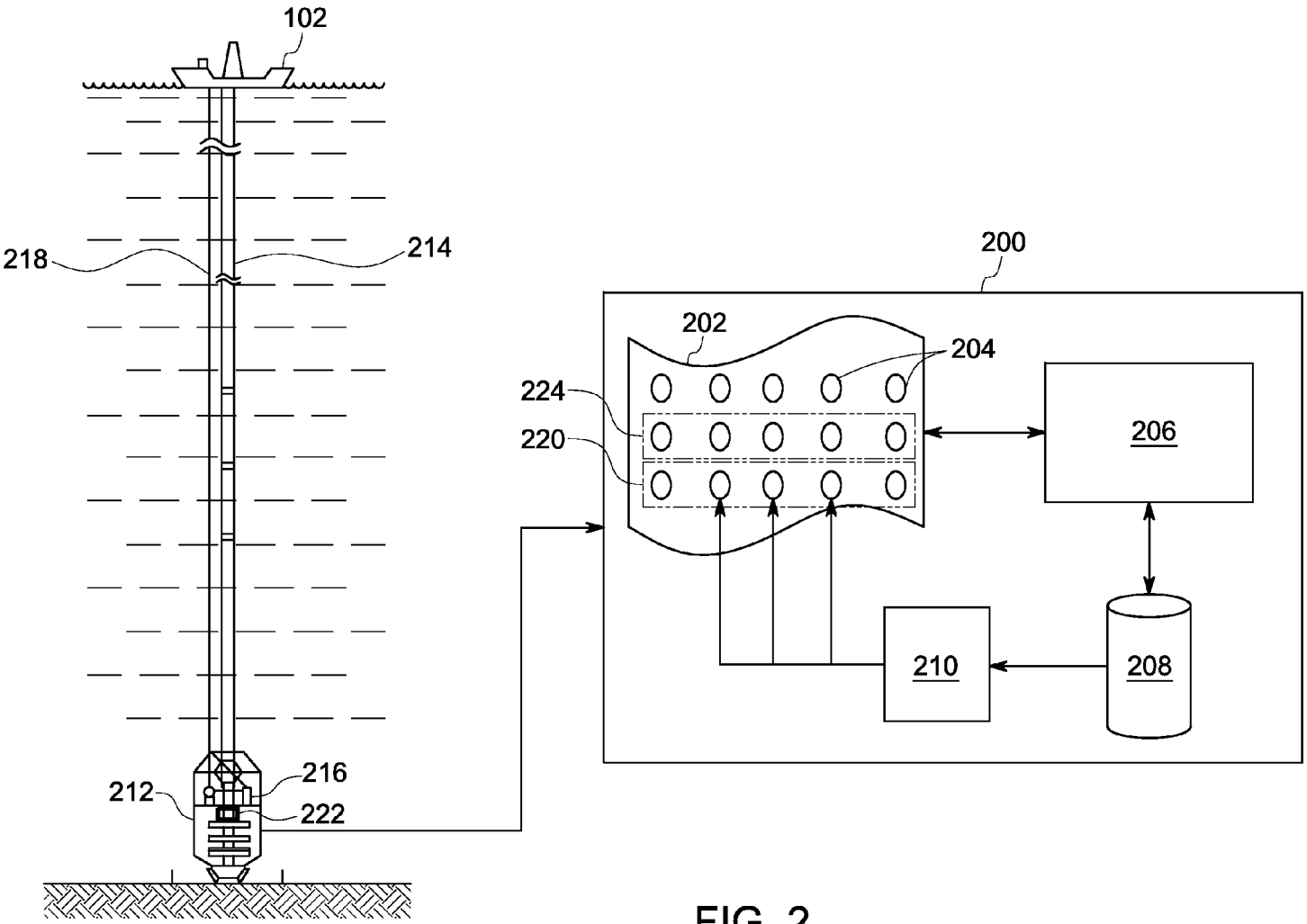
FIG. 2 illustrates a system for determination of a position of a pipe with respect to a BOP stack in an oil and gas exploration system, according to embodiments of the present invention.

FIG. 2 illustrates a system 200 for determination of a position of a pipe with respect to a BOP stack in an oil and gas exploration system, according to embodiments of the present invention. The oil and gas exploration system includes the system 200, a drill pipe 214, BOP stack 212, a controller 216, and hydraulic/electric lines 218 that couple the platform 102 to the controller 216 of the BOP stack 212. The system 200, according to certain embodiments, further includes a casing 202, a plurality of sensing devices 204, and a processing unit 206. The casing 202 is configured to be disposed around a section of the drill pipe 214 that needs to be monitored. The section of the pipe 214 to be monitored, according to one embodiment, may be the section of the pipe 214 present in the BOP stack 212. The casing 202 may be disposed around the section of interest of the pipe 214 when the pipe 214 is stationary. Further, the casing 202 may be disposed on the walls of the BOP stack 212 that face the pipe 214 when the pipe 214 is in motion. In other words, the casing 202 may be disposed in the BOP stack 212 such that the section of the pipe 214 present in the BOP stack 212 is covered by the casing 202. In some other embodiments, the casing 202 may be disposed on a region of a stationary protective casing, such as the protective casing 114, that is covered by the BOP stack 212. According to certain embodiments, the casing 202 may have an adjustable length and the length of the casing 202 may be selected based on the length of the section of the pipe 214 to be monitored. The length of the casing 202 is selected such that it is greater than or equal to the length of the section of pipe to be monitored. Moreover, when the casing 202 is placed in the BOP stack 212, the length of the casing 202 may be greater than or equal to the length of the BOP stack 212. The casing 202, according to certain embodiments, is a sheet made from a flexible material. Examples of flexible materials include, but are not limited to, elastomeric materials, rubber, fabrics, or any other suitable flexible materials. Adhesive materials may be disposed on two ends of the sheet such that when the two ends of the sheet are joined, they form a hollow cylindrical structure that is utilized as the casing 202. According to certain other embodiments, the casing 202 may be made from a rigid material. The casing 202 may be a hollow cylinder made from rigid material that may be placed along the outer surface of the pipe 214 or the inner surface of the BOP stack 214.

The sensing devices 204 are configured to generate a plurality of position signals. The sensing devices 204 may include transducers that are configured to generate signals that are incident on the pipe 214. The section of the pipe 214 that is exposed to the incident signals from the sensing devices 204 causes the signals to deflect and/or reflect. The changes caused by the section of interest of the pipe 214 are referred to as the response of the section of interest to the signals. The position signals include a response of the section of the pipe to the incident signals. Examples of sensing devices 204 may include, but are not limited to, ultrasound sensing devices, a radio frequency identification transmitter and token pair, and the like. The sensing devices 204 can be unidirectional as well as bi-directional. Bi-directional sensing devices 204 are configured to generate the signals incident on the pipe 214 and further receive the response from the section of interest of the pipe 214. Further, the sensing devices 204 are disposed on the casing 202 along the length of the casing 202 that is parallel to the direction of movement of the pipe 214 (from the platform 102 to the sea floor 108). The sensing devices 204 are grouped to form a plurality of arrays of sensing devices. One example of an array of sensing devices 204 is illustrated as reference numeral 220 in FIG. 2. Each array of sensing devices includes multiple sensing devices 204 that are placed proximate to one another to form a series of sensing devices 204. The arrays of sensing devices are placed along the length of the casing 202. According to one embodiment, when the casing 202, along with the sensing devices 204, is disposed on the outer surface of the section of the pipe 214 each sensing device 204 in an array of sensing device is configured to monitor the same portion along the length of the section of the pipe 214. For example, the sensing devices 204 in the array 220 are configured to monitor a section 222 of the segment of the pipe 214 present in the BOP stack 212. The section 222 is perpendicular to the length of the pipe 214. The signals produced by the plurality of sensing devices 204 are incident on the section of the pipe 214 being monitored. The sensing devices 204 are further configured to receive the responses (position signals) of the section of interest of the pipe 214 to the transmitted signals. The position signals are transmitted to the processing unit 206.

The processing unit 206, in certain embodiments, may comprise one or more central processing units (CPU) such as a microprocessor, or may comprise any suitable number of application specific integrated circuits working in cooperation to accomplish the functions of a CPU. The processor 206 may include a memory. The memory can be an electronic, a magnetic, an optical, an electromagnetic, or an infrared system, apparatus, or device. Common forms of memory include hard disks, magnetic tape, Random Access Memory (RAM), a Programmable Read Only Memory (PROM), and EEPROM, or an optical storage device such as a re-writeable CDROM or DVD, for example. The processing unit 206 is capable of executing program instructions, related to the determination of position of the pipe in the BOP, and functioning in response to those instructions or other activities that may occur in the course of or after determining the position of the pipe. Such program instructions will comprise a listing of executable instructions for implementing logical functions. The listing can be embodied in any computer-readable medium for use by or in connection with a computer-based system that can retrieve, process, and execute the instructions.

Alternatively, some or all of the processing may be performed remotely by additional processing units 206.

The processing unit 206 is configured to compute a distance between each sensing device 204 and the section of the pipe 214 being monitored. The distance between the sensing device 204 and the section of interest of the pipe 214 is computed through the plurality of position signals. Further, the processing unit 206 is configured to compare the distance between each sensing device 204 and the section of the pipe 214 being monitored. Based on the comparison of the distances between the sensing devices 204 and the section of the pipe 214 being monitored, the processing unit 206 is configured to generate a plurality of alerts. The plurality of alerts include a first alert that is generated when the distance determined between at least one sensing device 204 and the pipe 214 is different from a reference or expected distance between the pipe 214 and the sensing devices 204. The alerts also include a second alert that is generated when the distance between the pipe 214 and each sensing device 204 within at least one array of sensing devices is different from the reference distance between the pipe 214 and the sensing devices 204.

The reference or expected distance between the sensing devices 204 and the section of interest of the pipe 214 that is utilized to generate the first and second alert, may be provided to the processing unit 206 through various channels. These channels include, but are not limited to, an input from an operator, a predetermined distance determined from a reference pipe, and dynamic determination by the processing unit 206. Dynamic determination of the reference or expected distance by the processing unit 206 includes selecting an actual distance between the pipe 214 and one of the sensing devices 204 as the expected distance. To select one of the actual distances as the expected distance, the processing unit 206 may be configured to select a first set of sensor arrays from the plurality of arrays. The first set of sensor arrays includes those sensor arrays where the distance between the pipe 214 and each sensing device 204 within those arrays is equal. For example, during dynamic determination, the processing unit 206 may be configured to select the sensor array 220 to be one of the first set of arrays. The sensor array 220 is such that the distance between the pipe 214 and each sensing device 204 of the sensor array 220 is equal. Further, the processing unit 206 may also select sensor array 224 to be one of the first set of sensor arrays if the distance between each sensing device 204 of the array 224 and the pipe 214 is equal. Furthermore, the processing unit 206 compares the average distance observed by each array from the first set of arrays. For example, the average distance observed by the array 220 is compared with the average distance observed by the array 224 in the first set of sensor arrays. The processing unit 206 is further configured to select the average distance that is the largest among the average distances from the first set of sensor arrays as the reference or expected distance. For example, the average distance observed by the array 220 may be selected as the expected distance when the average distance of array 220 is greater than or equal to the average distance observed by the other array 224 in the first set of arrays. The processing unit 206, thus, is configured to select the distance between the array 220 and the pipe 214 as the expected distance, when the array 220 is placed to detect a section of the pipe 214 that has the least diameter in comparison with the rest of the pipe 214. For example, the array 220 may be disposed such that it is placed proximate to a section of the pipe that does not include a pipe joint. Whereas, the array 224 may be disposed such that it is proximate a pipe joint of the pipe 214. In such a scenario, in dynamic determination of the expected distance, the processing unit 206 is configured to select the distance between the array 220 and the pipe 214 as the expected distance.

The first and the second alert, according to one embodiment, may represent at least one condition associated with the pipe 214. The first alert, generated when one sensing device 204 of an array shows a measurement that is different from the other sensing devices 204 of that particular array, indicates that they pipe 214 may have displayed lateral movement. In other words, the first alert may be generated when the pipe 214 displays movement from the center of the protective casing 114 and/or the casing 202 towards one of the walls of the protective casing 114 and/or casing 202. The processing unit 206, while generating the first alert, compares the distance between each sensing device 204 and the pipe 214 to the expected distance. When the processing unit 206 determines, for a particular sensor array, that the distance between any one of the sensing devices 204 of that array and the pipe 214 is less than the distance between the remaining sensing devices 204 of that array and the pipe 214 or the expected distance, it generates the first alert. The second alert is an indication of the presence of a pipe joint in an operating range of the sensing devices 204 of the system 200. The array of sensing devices 200 are positioned such that the distance between two sensing arrays is greater than the length of the pipe joint. To generate the second alert, the processing unit 206 compares an average distance between each array and the pipe 214 with the expected distance. If the processing unit 206 determines that the average distance between each array and the pipe 214 is equal to the expected distance, it is concluded that the sensing devices 204 are not in the vicinity of any pipe joint. Further, if the processing unit 206 determines that a difference between the average distance for each array and the expected distance is within a specified range, it is concluded that the sensing devices 204 are not in the vicinity of any pipe joint. Furthermore, if the processing unit 206 determines that a difference between the average distance for each array and the expected distance is greater than the specified range, it is concluded that at least one array is in the vicinity of a pipe joint. The processing unit 206 concludes that the array for which the average distance is the least among the average distance for all arrays is in the vicinity of a pipe joint. The processing unit 206, thus, generates the second alert indicating that a particular array from the system 200 is in the vicinity of a pipe joint. The specified range for difference between the expected distance and the average distance is selected to be less than the difference between the diameter of a normal section of the pipe 214 and the diameter of the pipe joint.

The processing unit 206 is further communicably coupled with controller 216. The controller 216, based on the alerts generated by the processing unit 206, may be configured to take corrective actions based on the position of the pipe with respect to the BOP stack 212. Further, the processing unit 206 and/or controller 216 may communicate the alerts to the platform 102 through the hydraulic/electric lines 218. Corrective actions may be initiated from the platform 102 when the position of the pipe 214 with respect to the BOP stack 212 is not as desired. For example, the platform 102 may cause the pipe 214 to move in a direction that is orthogonal to the platform 102 when the first alert is generated. Further, the platform 102 may also cause the pipe 214 to move further in a direction towards the sea floor when the second alert is generated. The controller 216 may also be configured to modify the actuation of the BOP rams when either the first or the second alert are generated, thereby avoiding the ram to attempt shearing the pipe 214 at the pipe joint location.

The system further includes a data repository 208 that is coupled to the processing unit 206. The data repository 208 is configured to store prior pipe distances computed between the pipe and the sensing devices 204. Further, the data repository 208 is also configured to store the expected distance between the pipe 214 and the sensing devices 204. The processing unit 206 may also be configured to adjust the distance determined between each sensing device 204 and the pipe 214 with a compensation factor. The compensation factor may be dependent on characteristics of the fluid present between the space between the pipe 214 and the casing 202, or presence of foreign material in the space between the pipe 214 and the casing 202. The compensation factor helps in eliminating or reducing false alerts that may be generated by the processing unit 206 because of a change in the fluid characteristics in the pipe 214 as opposed to a comparison between distance of the pipe 214 with respect to the sensing devices 204 and the expected distance. The processing unit 206 compares the distance between each sensing device 214 and the pipe 202 with the expected distance between the sensing devices 214 and the pipe 202. The difference between each sensing device 204 and the pipe 214 and the expected distance is considered as the offset or gain factor. The offset or gain factor is communicated to the calibration unit 210. The calibration unit 210 adjusts subsequent measurements of each sensing device 204 with the appropriate compensation factor for each sensing device 204. Subsequent measurements of the sensing devices 204 are compared with the expected distance to a need for compensation in measurement.

Figure 3:
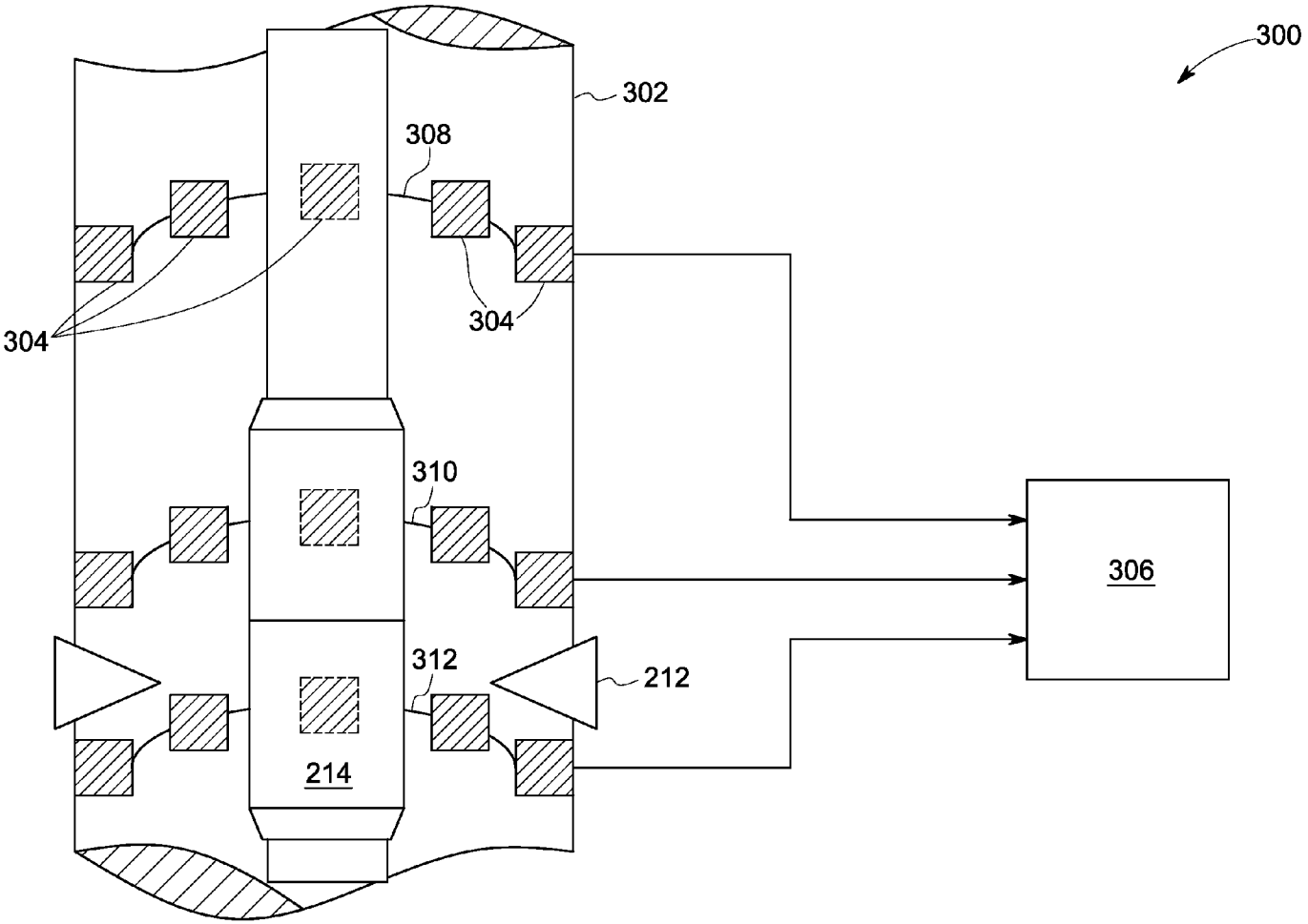
FIG. 3 illustrates a system for determination of a position of a pipe in a blowout preventer, according to one embodiment of the present invention.
Figure 4:
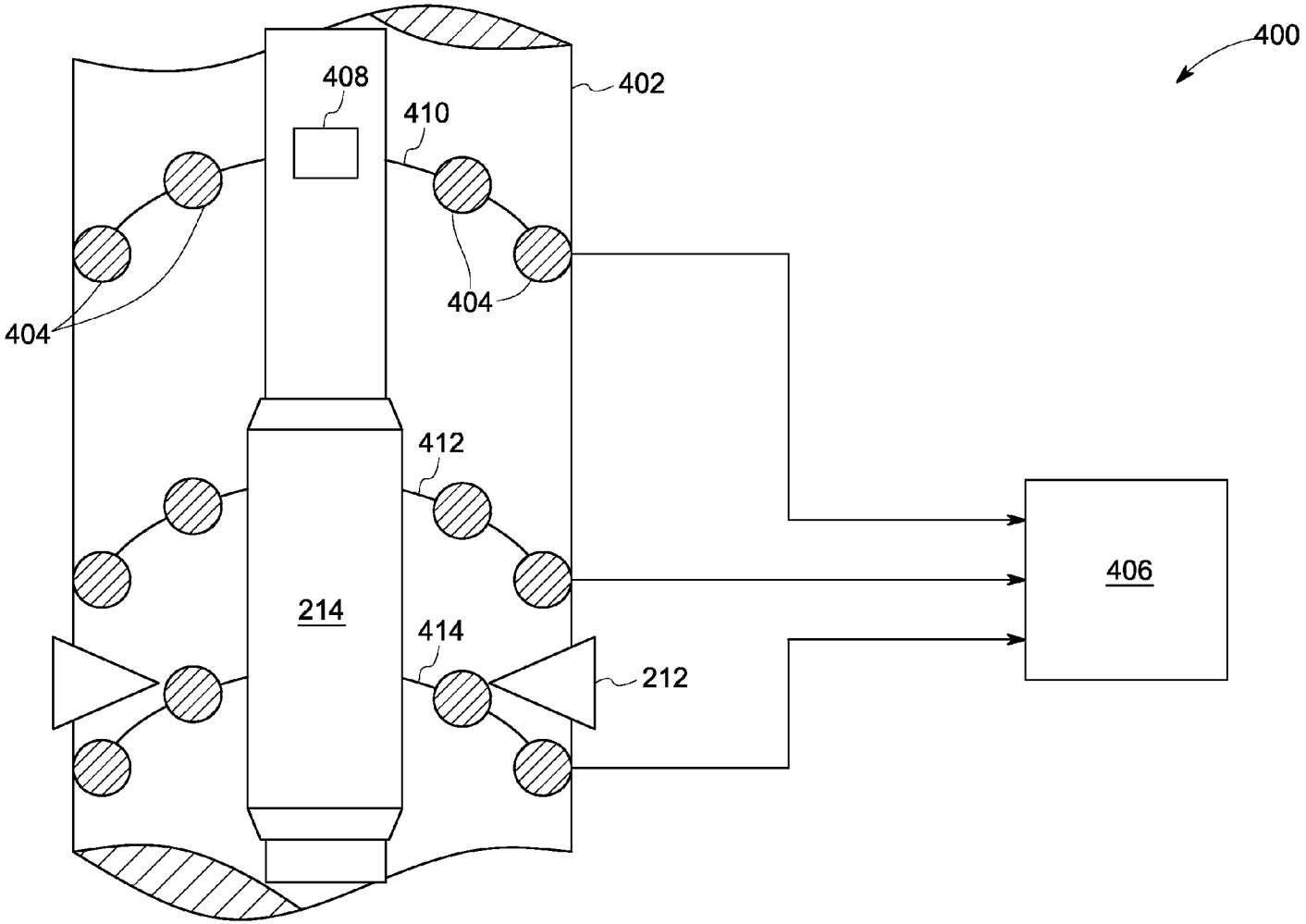
FIG. 4 illustrates a system for determination of a position of a pipe in a blowout preventer, according to another embodiment of the present invention.

Exemplary configurations of the system for determination of a position of the pipe 214 in the BOP stack 212, based on different type of sensing devices 204, are explained in conjunction with FIGS. 3 and 4.

FIG. 3 illustrates an exemplary embodiment 300 of a system for determination of the position of a pipe 214 with respect to the BOP stack 212. The system 300 includes a casing 302, a plurality of sensing devices 304, and a processing unit 306. The casing 302, as described in connection with FIG. 2, may be made from flexible materials or from rigid materials and is configured to be disposed around the outer surface of the section of the pipe 214 that is being monitored. In certain embodiments, the casing 302 is disposed around the inner surface of the BOP stack 212 such that a sections of the pipe 214 that are present in the BOP stack 212 when the pipe 214 is moving can be monitored. In the illustrated embodiment, the section of the pipe 214 that is being monitored is present in the BOP stack 212.

Further, in the illustrated embodiment, the sensing devices 304 are disposed on the casing 302. The sensing devices 304 are arranged on the casing 302 to form a plurality of arrays of sensing devices 308, 310, and 312. Each array of sensing devices 308, 310, and 312 include one or more sensing devices 304 that are placed in a plane orthogonal to the length of the pipe 214. The casing 302, in one embodiment, is wrapped around the section of interest of the pipe 214. The casing 302 is sealed at ends to define a cylindrical structure that is disposed around the pipe 214. In another embodiment, the casing 302 provides for an opening to allow the pipe 214 to be surrounded by the walls of the casing 302. When the casing 302 is wrapped around the pipe 214, each array 308, 310, and 312 encompasses a portion of the pipe in a circumferential fashion. Further, the arrays 308, 310, and 312 are spaced apart from each other along the length of the casing 302 that is parallel to the direction of movement of the pipe 214 (from the platform 102 to the sea floor 108). During operation, when the casing 302 is disposed on the pipe 214, the arrays 308, 310, and 312 of the sensing devices 304 cover the length of the section of the pipe 214 being monitored as well as the circumference of the section of interest of the pipe 214. The sensing devices 304 are configured to determine the distance between the sensing devices 304 and the pipe 214. The sensing devices 304, according to certain embodiments, may be unidirectional or bidirectional ultrasound sensing devices.

The sensing devices 304, when provided with excitation signals, are configured to transmit signals that are incident on the pipe 214. The signals get deflected and/or reflected from the surface of the pipe 214. This signal response of the pipe 214, also termed as position signal, to the signals transmitted by the sensing devices 304 is captured by the sensing devices 304. The position signals are transmitted to the processing unit 306 that is configured to determine the distance between the pipe 214 and each sensing device 304.

The processing unit 306 determines the distance between the pipe and each sensing device 304, for example, by the time taken by the respective sensing device 304 to collect the reflections of the input signals from the pipe surface. The processing unit 306 is further configured to generate a plurality of alerts based on the analysis of distances between the pipe 214 and each sensing device 304. In operation, the processing unit 306 compares the distance between each sensing device 304 and the pipe 214 with a reference or expected distance to generate the plurality of alerts. Specifically, the processing unit 306 generates a first alert when the distance between at least one sensing device 304 and the pipe is different from the reference distance. The second alert, on the other hand, is generated when the distance between the pipe and each sensing device 304 of at least one array 308, or 310, or 312 is different from the reference distance.

In one embodiment, the processing unit 306 receives the reference distance from the operator through a user interface. Further, the reference distance may also be determined from a reference pipe and provided to the processing unit 306. Furthermore, the processing unit 306 may also dynamically determine the reference distance from the present distances determined between the sensing devices 304 and the pipe 214. In dynamic determination, the processing unit 306 selects one of the actual distances between the sensing devices 304 and the pipe 214. To select one of the actual distances as the expected distances, the processing unit 306 determines a first set of arrays from the plurality of arrays 308, 310, and 312. The first set of arrays includes an array where the distance between the pipe 214 and each sensing device 304 of that particular array is equal. For example, the first set of arrays may include sensor arrays 308 and 310 when the distance between each sensing device 304 of the array 308 and the pipe 214 is equal and the distance between sensing devices 304 of the array 310 and the pipe 214 is equal. Further, the processing unit 306 compares the average distance observed by each array from the first set of arrays. For example, the average distance observed by the array 308 is compared with the average distance observed by the other array 310 in the first set of arrays. The processing unit 306 is further configured to select the average distance that is greater than remaining average distances from the first set of arrays as the reference or expected distance. For example, the average distance observed by the array 308 may be selected as the expected distance when the average distance of array 308 is greater than or equal to the average distance observed by the other array 310 in the first set of arrays. The processing unit 306, thus, is configured to select the distance between the array 308 and the pipe 214 as the expected distance, when the array 308 is positioned to detect a section of the pipe 214 that has the least diameter in comparison with the rest of the pipe 214. For example, the array 308 may be disposed such that it is placed proximate to a section of the pipe that does not include a pipe joint. Whereas, the array 310 may be disposed such that it is proximate a pipe joint of the pipe 214. In such a scenario, in dynamic determination of the expected distance, the processing unit 306 is configured to select the distance between the array 308 and the pipe 214 as the expected distance.

FIG. 4 illustrates another exemplary embodiment 400 of a system for determination of the position of a pipe in a BOP. The system includes a casing 402, a plurality of sensing devices 404, a processing unit 406, and an identification token 408. The sensing devices 404 are disposed on the casing 402 to define a plurality of arrays 410, 412, and 414 of sensing devices 404. The casing 402 is disposed on an outer surface of the section of the pipe 214 being monitored. The identification token 408 is placed at a predetermined location on the section of the pipe being monitored. The identification token 408 may be an active token as well as a passive token.

Each sensing device 404, according to one embodiment, includes a transceiver that is configured to transmit interrogation signals to the section of the pipe 214 being monitored. In one embodiment, the interrogation signals may be radio frequency (RF) signals that are incident on the pipe 214 being monitored. The identification token 408 placed at the predetermined position on the pipe 214 being monitored, receives the transmitted interrogation signal and generates a response to the transmitted signal. The response, termed as position signals, is communicated to the processing unit 406. The processing unit 406 is configured to determine the distance between the pipe and the sensing devices 404 based on the position signals. According to one embodiment, the processing unit 406 is configured to compute the distance between each sensing device 404 and the pipe 214 using the strength of the position signals received by the sensing devices 404. The processing unit 406 may also include a plurality of signal processing components that are configured to eliminate noise from the position signals received from the sensing devices 404. Further, the processing unit 406 may be configured to compute the distance between the sensing devices 404 and the pipe 214 by measuring a time taken to receive the position signal at each sensing device 404 from the token 408.

In the case where identification tokens 408 are active identification tokens, the identification tokens 408 are configured to periodically transmit position signals to the sensing devices 404. The processing unit 406 is configured to determine the distance between the sensing device 404 and the pipe 214 based on the strength of the position signals received by each sensing device 404.

During operation, each sensing device 404 generates a signal directed towards the identification token 408 and receives a position signal from the identification token 408. The processing unit 406 computes the distance between the pipe 214 and the sensing device 404 based on each position signal. Further, the processing unit 406 determines a reference distance for monitoring the pipe 214. The reference distance is computed from the distance between each sensing device 404 and the pipe 214. The processing unit 406 is further configured to generate alerts based on a comparison between the distance between the sensing device 404 and the pipe 214 and the reference distance.

Figure 5:
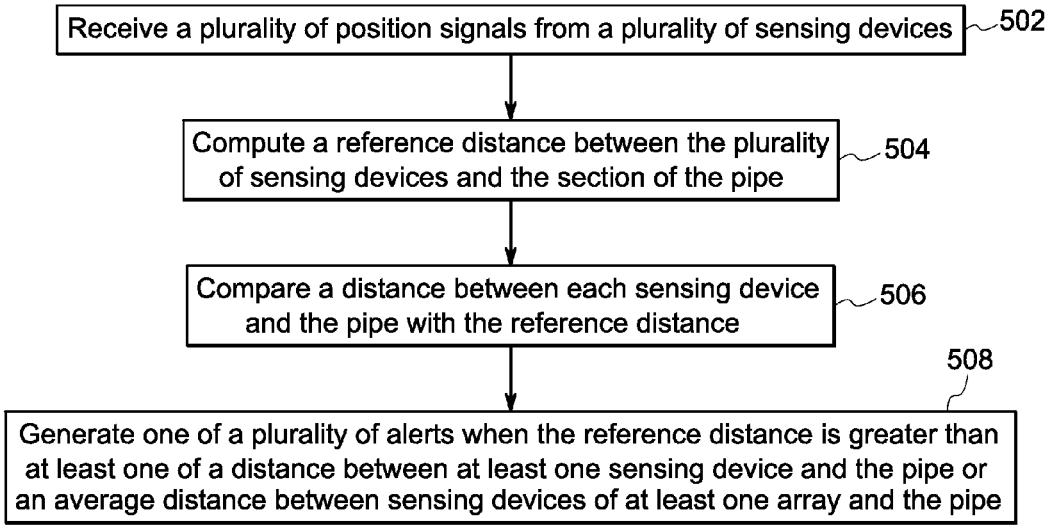
FIG. 5 illustrates a flowchart of a method for determination of position of pipe in a blowout preventer, according to one embodiment of the present invention.

FIG. 5 illustrates a flow diagram of a method for determination of a position of a pipe 214 in a BOP stack 212. At 502, the method includes receiving a plurality of position signals from a plurality of sensing devices. The plurality of position signals are generated as a response to an input signal generated by each of the plurality of sensing devices that is incident on the pipe being monitored. The sensing devices are disposed on a casing that is disposed on an outer surface of the pipe being monitored. The sensing devices are arranged on the casing to define a plurality of arrays of sensing devices. The arrays of sensing devices are arranges such that each array covers the pipe circumferentially and the arrays of sensing device cover the length of the casing.

Further, at 504, a reference distance between the sensing devices and the pipe is computed. The reference distance between the sensing devices and the pipe is computed based on the determined distance between each sensing device and the pipe. The distance that is greatest among the determined distances may be selected as the reference distance. Further, at 506, the method includes comparing the distance of each sensing device with respect to the pipe with the reference distance. At 508, the method includes generating alerts when the reference distance is greater than the distance between at least one of the plurality of sensing devices and the pipe or when the reference distance is greater than the average of distances between sensing devices of at least one array of sensing devices and the pipe.

Various embodiments described above thus provide for a method and a system for determination of a position of a pipe in a blowout preventer. The system for determination generates alerts for a change in position caused by lateral and/or angular movement of the pipe within the BOP. Further, the system also generates an alert when a portion of the pipe that is larger in diameter than the remaining pipe is present in the BOP. The system includes dynamic determination of the reference distance, thus taking into account offsets caused in each sensing device due to the presence of foreign material that may interfere with the response signals from the pipe. Further, the system includes a self-calibration mechanism that allows for the system to be efficient and useful for determination of position of pipes even when the overall diameter of the pipe in the BOP changes.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments of invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for determination of position of a pipe in a BOP, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A system to detect a position of a pipe with respect to a blowout preventer (BOP), comprising:

a casing configured to be disposed around an outer surface of a section of the pipe, wherein a length of the casing is greater than or equal to a length of the section of the pipe;

a plurality of ultrasound sensing devices configured to generate a plurality of position signals, wherein the plurality of sensing devices are arranged to form a plurality of arrays of sensing devices and wherein each of the plurality of arrays is disposed circumferentially around the casing and spaced from one another along the length of the casing; and a processing unit configured to:

compute a distance between the pipe and each of the plurality of sensing devices based on the plurality of position signals;

generate a first alert when the distance of the pipe determined from at least one sensing device is different from a reference distance between the pipe and the sensing devices; and generate a second alert when the distance between the pipe and each sensing device of at least one array of sensing devices is different from the reference distance between the pipe and sensing devices.

2. The system of claim 1, wherein the reference distance between the pipe and sensing devices comprises a distance between the pipe and at least one sensing device of the plurality of sensing devices.

3. The system of claim 2, wherein the processing unit is further configured to:

compare an average distance between each of a first set of arrays and the pipe, wherein the distances between each sensing device in each array of the first set of arrays and the pipe is equal to the distance between remaining sensing devices of the respective array and the pipe; and select an average distance that is greater than remaining average distances as the reference distance.

4. The system of claim 1, wherein the reference distance between the pipe and sensing devices comprises a predetermined distance between a reference pipe and the sensing devices.

5. The system of claim 1, wherein the reference distance between the pipe and sensing devices comprises a distance provided by an operator.

6. The system of claim 1, wherein the plurality of position signals comprises a response of the pipe to incident ultrasound signals that are transmitted by the plurality of sensing devices, and wherein the distance of the pipe is determined from the time taken by the sensing devices to collect the response of the pipe to the incident ultrasound signals.

7. The system of claim 1, further comprising a data repository configured to store prior pipe distance information with respect to the sensing devices.

8. The system of claim 7, wherein the processing unit is configured to compare the distance of the pipe with respect to the plurality of sensing devices determined from the plurality of position with the prior pipe distance information.

9. The system as recited in claim 8, further comprising a calibration unit configured to calibrate the plurality of sensing devices when a difference between the prior pipe distance and the distance of the pipe with respect to each sensing device determined from the plurality of position signals is the same.

10. A system to detect a position of a pipe with respect to a blowout preventer (BOP) comprising:

a casing configured to be disposed around an outer surface of a section of the pipe, wherein a length of the casing is greater than or equal to a length of the section of the pipe;

a plurality of radio frequency transmitters configured to generate plurality of position signals, wherein the plurality of radio frequency transmitters are arranged to form a plurality of arrays of radio frequency transmitters and wherein each of the plurality of arrays is disposed circumferentially around the casing and spaced from one another along the length of the casing; and a processing unit configured to:

compute a distance between the pipe and each of the plurality of radio frequency transmitters based on the plurality of position signals;

generate a first alert when the distance of the pipe determined from at least one radio frequency transmitter is different from a reference distance between the pipe and the radio frequency transmitters; and generate a second alert when the distance between the pipe and each radio frequency transmitter of at least one array of radio frequency transmitters is different from the reference distance between the pipe and radio frequency transmitters.

11. The system of claim 10, further comprising a radio frequency identification token that is placed at a predefined location on the pipe.

12. The system of claim 11, wherein the plurality of position signals comprises a response of the radio frequency identification token to interrogation signals transmitted by the radio frequency transmitters, and wherein the distance of the pipe is determined from a strength of the response of the radio frequency identification token to the interrogation signals.

13. A method for monitoring a position of a pipe with respect to a blow-out preventer (BOP), comprising:

receiving a plurality of position signals including a response to ultrasound signals transmitted by a plurality of ultrasound sensing devices, wherein the plurality of sensing devices are disposed on a casing to form a plurality of arrays of sensing devices along the length of the casing, and wherein the casing is disposed on an outer surface of a section of the pipe;

computing a reference distance between the plurality of sensing devices and the section of the pipe;

comparing a distance between each sensing device and the pipe with the reference distance; and generating at least one of a plurality of alerts when the reference distance is greater than at least one of a distance between at least one sensing device and the pipe or an average distance between sensing devices of at least one array and the pipe.

14. The method of claim 13, wherein comparing the plurality of position signals comprises comparing time taken to receive the response from the pipe to the ultrasound signal transmitted by each of the plurality of sensing devices.

15. The method of claim 13, further comprising generating an alert when the determined position of the pipe with respect to the BOP is different from an initial position of the pipe with respect to the BOP.

16. A method for monitoring a position of a pipe with respect to a blow-out preventer (BOP), comprising:

receiving a plurality of position signals including a response to a radio frequency interrogation signal transmitted by each of the plurality of sensing devices, wherein the plurality of sensing devices are disposed on a casing to form a plurality of arrays of sensing devices along the length of the casing, and wherein the casing is disposed on an outer surface of a section of the pipe;

computing a reference distance between the plurality of sensing devices and the section of the pipe;

comparing a distance between each sensing device and the pipe with the reference distance; and generating at least one of a plurality of alerts when the reference distance is greater than at least one of a distance between at least one sensing device and the pipe or an average distance between sensing devices of at least one array and the pipe.

17. The method of claim 16, wherein comparing the plurality of position signals comprises comparing strength of the response to the radio frequency interrogation signal transmitted by each of the plurality of sensing devices.

18. A system to detect a position of a pipe with respect to a blowout preventer (BOP), comprising:

a casing configured to be disposed around an outer surface of a section of the pipe, wherein a length of the casing is greater than or equal to a length of the section of the pipe;

a plurality of bi-directional sensing devices configured to generate a plurality of position signals, wherein the plurality of bi-directional sensing devices are arranged to form a plurality of arrays of bi-directional sensing devices, wherein each array is disposed circumferentially around the casing and spaced from one another along the length of the casing, and wherein each of the plurality of arrays of bi-directional sensing devices is configured to transmit signals and receive responses based on those signals; and a processing unit configured to:

compute distances between the pipe and the plurality of bi-directional sensing devices based on the plurality of position signals; and determine at least one of lateral movement of the pipe and presence of a pipe joint based on the distances.

19. The system of claim 18, wherein the processor is further configured to:

identifying lateral movement of the pipe when the distance of the pipe determined from at least one sensing device is different from a reference distance between the pipe and the bi-directional sensing devices; and identifying presence of a pipe joint when the distance between the pipe and each bi-directional sensing device of at least one array of bi-directional sensing devices is different from the reference distance between the pipe and sensing devices.

* * * * *